US010858612B2

(12) United States Patent
Raaijmakers et al.

(10) Patent No.: US 10,858,612 B2
(45) Date of Patent: Dec. 8, 2020

(54) DETERGENT COMPOSITION COMPRISING A CATIONIC DERIVATIVE OF A POLYSACCHARIDE

(71) Applicants: Koninklijke Coöperatie Cosun UA, Breda (NL); Dalli-Werke GmbH & Co. KG, Stolberg (DE)

(72) Inventors: Harry Raaijmakers, Roosendaal (NL); Tom Brooijmans, Breda (NL); Robbert de Boer, Oene (NL); Khalid Mahmud, Elburg (NL); René Mol, Hollandscheveld (NL)

(73) Assignee: COÖPERATE KONINKLIJKE COSUN U.A., Breda (DE)

( * ) Notice: Subject to any disclaimer, the term of this patent is extended or adjusted under 35 U.S.C. 154(b) by 380 days.

(21) Appl. No.: 15/797,719

(22) Filed: Oct. 30, 2017

(65) Prior Publication Data

US 2018/0119055 A1 May 3, 2018

(30) Foreign Application Priority Data

Oct. 31, 2016 (EP) ..... 16196619

(51) Int. Cl.

| | |
|---|---|
| ***C11D 3/22*** | (2006.01) |
| ***C11D 7/26*** | (2006.01) |
| ***C11D 3/395*** | (2006.01) |
| ***C11D 3/08*** | (2006.01) |
| ***C11D 3/12*** | (2006.01) |
| ***C11D 3/06*** | (2006.01) |
| ***C11D 3/386*** | (2006.01) |
| ***C11D 3/00*** | (2006.01) |
| ***C11D 11/00*** | (2006.01) |
| ***A47L 15/00*** | (2006.01) |

(52) U.S. Cl.

CPC ..... *C11D 3/222* (2013.01); *A47L 15/0002* (2013.01); *C11D 3/0036* (2013.01); *C11D 3/06* (2013.01); *C11D 3/08* (2013.01); *C11D 3/128* (2013.01); *C11D 3/227* (2013.01); *C11D 3/228* (2013.01); *C11D 3/386* (2013.01); *C11D 3/395* (2013.01); *C11D 7/268* (2013.01); *C11D 11/0023* (2013.01); *A47L 2601/20* (2013.01)

(58) Field of Classification Search

None

See application file for complete search history.

(56) References Cited

U.S. PATENT DOCUMENTS

| | | | | |
|---|---|---|---|---|
| 6,172,019 | B1 * | 1/2001 | Dehan | A61K 8/31 510/130 |
| 2002/0082399 | A1 | 6/2002 | Kuzee | |
| 2006/0045861 | A1 | 3/2006 | Bejger | |
| 2011/0002868 | A1 * | 1/2011 | Bierganns | A61K 8/922 424/70.13 |
| 2013/0310298 | A1 | 11/2013 | Labarre | |
| 2015/0069086 | A1 * | 3/2015 | Pedley | A47L 15/4445 134/93 |

FOREIGN PATENT DOCUMENTS

GB 1604030 A 12/1981

OTHER PUBLICATIONS

Extended European Search Report issued in European Patent Application No. 16196619.7, dated Apr. 14, 2017, 11 pages.

Van Engelen et al., "Clean products from a clean planet for a clean future", SOFW-Journal, Oct. 2010, pp. 58-62, XP002768951, 4 pages.

* cited by examiner

*Primary Examiner* — Eric W Golightly
*Assistant Examiner* — Arlyn I Rivera-Cordero
(74) *Attorney, Agent, or Firm* — Foley & Lardner LLP; Sunit Talapatra

(57) ABSTRACT

The invention relates to a detergent composition comprising at least one cationic derivate of a polysaccharide. The cationic derivate has an average molecular weight of less than 30000 g/mol, a degree of substitution ranging between 0.01 and 3. The invention further relates to a method of reducing, limiting or preventing the occurrence of spotting and/or filming on hard surface substrates during rinsing or washing and to the use of a detergent composition to reduce, limit or prevent the occurrence of spotting and/or filming on hard surface substrates during rinsing and/or washing.

11 Claims, No Drawings

DETERGENT COMPOSITION COMPRISING A CATIONIC DERIVATIVE OF A POLYSACCHARIDE

CROSS-REFERENCE TO RELATED APPLICATIONS

This non-provisional U.S. Patent Application claims priority to European Patent Application No. 16196619.7, filed Oct. 31, 2016, the contents of which are herein incorporated by reference in its entirety.

FIELD OF THE INVENTION

The invention relates to a detergent composition, more particularly an automatic dishwashing detergent composition, demonstrating good anti-spotting and anti-filming properties on hard surface substrates cleaned with such detergent composition. The invention further relates to a method to prepare such detergent composition and to a method to reduce, limit or prevent the occurrence of spotting and filming on substrates cleaned with such detergent composition and to the use of such detergent composition.

BACKGROUND ART

Detergent compositions for dishwashing such as automatic dishwashing detergent compositions are well-known in the art. It is a well-known problem that hard surface substrates cleaned by an automatic dishwashing detergent compositions may suffer from spotting and filming due to mineral deposits being left once the cleaning has been completed. Spotting and filming reduces the shine of the cleaned surface and is aesthetically displeasing. The appearance of a shiny surface is tremendously important to consumers as it is perceived as showing thorough and hygienic cleaning results. Consequently, the occurrence of spotting and filming calls into question the cleanliness of the glassware, dishware and tableware.

One solution to avoid or reduce the spotting and filming is to use builders and/or surfactants. However, as these compounds are not environmentally friendly, there is a need to provide improved detergent composition comprising environmentally friendly components.

Although some detergent compositions known in the art comprising cationic polysaccharides show good performance in preventing spotting, they can not avoid the occurrence of films. For other detergent compositions known in the art comprising cationic polysaccharides the formation of films can be avoided but they do not allow to prevent spotting.

The use of cationic polysaccharides having a high molecular weight for an automatic dishwashing detergent composition is described in US2013/0310298.

SUMMARY OF THE INVENTION

It is an object of the present invention to provide a detergent composition eliminating or reducing the formation of spots as well as the formation of films on hard surface substrates in an automatic dishwashing process.

It is another object of the present invention to provide a detergent composition combining a cationic derivate of a polysaccharide having an average molecular weight lower than 30000 g/mol and a degree of substitution ranging between 0.01 and 3.

It is a further object of the present invention to provide a method of reducing, limiting or preventing the occurrence of spotting and/or filming on hard surface substrates during rinsing and/or washing is provided. It is in particular an object to provide a method of reducing, limiting or preventing the occurrence of spotting and the occurrence of filming on hard surface substrates during washing.

Furthermore it is an object to provide the use of a detergent composition to reduce, limit or prevent the occurrence of spotting and/or filming during rinsing and/or washing of hard surface substrates.

DESCRIPTION OF EMBODIMENTS

A first aspect of the present invention relates to a detergent composition comprising at least one cationic derivative of a polysaccharide. The cationic derivative of the polysaccharide has an average molecular weight of less than 30000 g/mol and a degree of substitution ranging between 0.01 and 3.

Preferably, the cationic derivate of the polysaccharide has a solubility in water at a temperature of 25° C. of at least 20% (wt).

For the purpose of this application "polysaccharides" are polymer carbohydrate molecules composed of long chains of monosaccharide units bound together by glycosidic linkages.

A "cationic derivative of a polysaccharide" is understood to be a polysaccharide or a derivate of a polysaccharide comprising a cationic group. The cationic group may comprise an ammonium group, a quaternary ammonium group, a sulfonium group, a phosphonium group, a transitional metal or any other positively charged functional group. A preferred cationic group is a quaternary ammonium group.

The cationic derivative of the polysaccharide of the detergent composition has preferably an average molecular weight lower than 30000 g/mol and more preferably an average molecular weight ranging between 500 g/mol and 30000 g/mol. In preferred embodiments the average molecular weight of the cationic derivative of the polysaccharide ranges between 1000 g/mol and 15000 g/mol and more preferably between 2000 g/mol and 5000 g/mol.

The "degree of substitution" is defined as the cationic group content per monosaccharide unit. Preferably, the degree of substitution of the cationic polysaccharide ranges between 0.01 and 3. More preferably, the degree of substitution of the cationic derivate of a polysaccharide ranges between 0.05 and 2.5, for example between 0.1 and 2, between 0.15 and 2, between 0.15 and 1.5, between 0.2 and 0.9 or between 0.30 and 0.90.

"Solubility" is defined as the maximum percentage (by weight) of a substance that will dissolve in a unit of volume of water at a certain temperature. The solubility of the cationic derivate of the cationic polysaccharide present in the detergent composition of the present invention in water at a temperature of 25° C. is preferably higher than 20% (wt), for example higher than 30% (wt), higher than 40% (wt), higher than 45% (wt), higher than 50% (wt), higher than 60% (wt), higher than 70% (wt) and higher than 80% (wt).

Preferred cationic derivates of a polysaccharide have an average molecular weight ranging between 1000 g/mol and 15000 g/mol and a degree of substitution ranging between 0.15 and 2. Even more preferred cationic derivates of a polysaccharide have an average molecular weight ranging between 2000 g/mol and 5000 g/mol and a degree of substitution ranging between 0.30 and 0.90. The solubility of the cationic derivate of the polysaccharide in water at a temperature of 25° C. is preferably higher than 20% (wt) and more preferably higher than 40% (wt).

A preferred group of polysaccharides comprises fructans. For the purpose of this application "fructans" are understood to comprise all polysaccharides which have a multiplicity of anhydrofructose units. The fructans can have a polydisperse chain length distribution and can be straight-chain or branched. The fructans comprise both products obtained directly from a vegetable or other source and products in which the average chain length has been modified (increased or reduced) by fractionation, enzymatic synthesis or hydrolysis. The fructans have an average chain length (=degree of polymerization, DP) of at least 2 to about 1000, in particular between 3 and 60, for example 3, 4, 5, 6, 7, 8, 15 or 25.

For the purpose of the present application "a cationic derivate of fructan" is understood to be a derivate of fructan comprising a cationic group. The cationic group may comprise an ammonium group, a quaternary ammonium group, a sulfonium group, a phosphonium group, a transitional metal or any other positively charged functional group. A preferred cationic group is a quaternary ammonium group.

The cationic derivate of fructan has preferably an average molecular weight lower than 30000 g/mol and more preferably an average molecular weight ranging between 500 g/mol and 30000 g/mol. In preferred embodiments the average molecular weight of the cationic derivative of fructan ranges between 1000 g/mol and 15000 g/mol and more preferably between 2000 g/mol and 5000 g/mol.

The degree of substitution of the cationic derivate of fructan ranges preferably between 0.01 and 3. More preferably, the degree of substitution of the cationic derivate of fructan ranges between 0.05 and 2.5, for example between 0.1 and 2, between 0.15 and 2, between 0.15 and 1.5, between 0.2 and 0.9 or between 0.30 and 0.90.

The solubility of the cationic derivate of fructan in water at a temperature of 25° C. is preferably higher than 20% (wt), for example higher than 30% (wt), higher than 40% (wt), higher than 45% (wt), higher than 50% (wt), higher than 60% (wt), higher than 70% (wt) and higher than 80% (wt).

Preferred cationic derivates of fructan have an average molecular weight ranging between 1000 g/mol and 15000 g/mol and a degree of substitution ranging between 0.15 and 2. Even more preferred cationic derivates of fructan have an average molecular weight ranging between 2000 g/mol and 5000 g/mol and a degree of substitution ranging between 0.30 and 0.90. The solubility of the cationic derivate of fructan in water at a temperature of 25° C. is preferably higher than 20% (wt) and more preferably higher than 40% (wt).

A preferred group of fructans comprises inulins. For the purpose of this application "inulins" are understood to comprise polysaccharides comprising β(2,1) linked fructofuranose units and a glucopyranose unit. The degree of polymerization ranges preferably between 2 and 60. Inulin can for example be obtained from chicory, dahlias and Jerusalem artichokes.

A preferred group of cationic derivates of fructans comprise cationic inulin. For the purpose of the present application "a cationic derivate of inulin" is understood to be a derivate of inulin comprising a cationic group. The cationic group may comprise an ammonium group, a quaternary ammonium group, a sulfonium group, a phosphonium group, a transitional metal or any other positively charged functional group. A preferred cationic group is a quaternary ammonium group. Cationic inulin is known and sold under the trademark Catin® (a trademark of Cosun Biobased Products).

The cationic inulin has preferably an average molecular weight of less than 30000 g/mol and more preferably an average molecular weight ranging between 500 g/mol and 30000 g/mol. In preferred embodiments the average molecular weight of the cationic inulin ranges between 1000 g/mol and 15000 g/mol and more preferably between 2000 g/mol and 5000 g/mol.

The cationic inulin preferably has preferably a degree of substitution ranging between 0.01 and 3. More preferably, the degree of substitution of the cationic inulin ranges between 0.05 and 2.5, for example between 0.1 and 2, between 0.15 and 2, between 0.15 and 1.5, between 0.2 and 0.9 or between 0.30 and 0.90.

The cationic inulin has preferably a solubility in water at a temperature of 25° C. higher than 20% (wt), for example higher than 30% (wt), higher than 40% (wt), higher than 45% (wt), higher than 50% (wt), higher than 60% (wt), higher than 70% (wt) and higher than 80% (wt).

The cationic inulin has preferably an average molecular weight ranging between 1000 g/mol and 15000 g/mol and a degree of substitution ranging between 0.15 and 2. Even more preferably the cationic inulin has average molecular weight ranging between 2000 g/mol and 5000 g/mol and a degree of substitution ranging between 0.30 and 0.90. The solubility of the cationic inulin in water at a temperature of 25° C. is preferably higher than 20% (wt) and more preferably higher than 40% (wt).

A detergent composition according to the present invention comprises preferably between 0.01 wt % and 2 wt % of a cationic derivate of a polysaccharide. More preferably, a detergent composition according to the present invention comprises between 0.01 wt % and 1 wt % or between 0.02 wt % and 0.5 wt % of a cationic derivate of a polysaccharide. Examples of detergent compositions comprise 0.02 wt %, 0.04 wt % 0.08 wt %, 0.15 wt %, 0.2 wt %, 0.3 wt %, 0.4 wt %, 0.5 wt %, 0.7 wt %, 1.0 wt %, 1.1 wt %, 1.2 wt % or 1.5 wt % of a cationic derivate of a polysaccharide.

The detergent composition according to the present invention comprises for example between 0.01 wt % and 2 wt % of a cationic derivate of fructan as for example cationic inulin. Preferred embodiments comprise between 0.01 wt % and 1 wt % or between 0.02 wt % and 0.5 wt % of a cationic derivate of fructan as for example cationic inulin. Examples of detergent compositions comprise for example 0.02 wt %, 0.04 wt %, 0.08 wt %, 0.15 wt %, 0.2 wt %, 0.3 wt %, 0.4 wt %, 0.5 wt %, 0.7 wt %, 1.0 wt %, 1.1 wt %, 1.2 wt % or 1.5 wt % of a cationic derivate of fructan as for example cationic inulin.

The detergent composition according to the present invention comprises preferably an automatic dishwashing detergent composition.

The detergent composition according to present invention may further comprise additional ingredients such as surfactants, builders, bleaching agents, bleach activators, bleach catalysts, dyes, polymers, corrosion inhibitors, complexing agents, anti-redeposition agents, perfumes, process aids and/or enzymes.

As surfactant all surfactants commonly known to be used in detergent compositions can be part of the composition, this includes all anionic, non-ionic, cationic and amphoteric surfactants known in the art. The present invention is not limited by any of the surfactants commonly used in automatic dishwashing compositions.

Builders may comprise inorganic non-phosphate builders (for example phosphonates, silicates, carbonates, sulphates, citrates and aluminosilicates), organic builders (for example (poly)carboxylated compounds), phosphoric builders (for example alkali metal phosphates). Also complexing agents can be considered as co-builder.

Bleaching agents comprise for example active chlorine compounds, inorganic peroxygen compounds and organic peracids. Examples are sodium percarbonate, sodium perborate monohydrate, sodium perborate tetrahydrate, hydrogen peroxide, hydrogen peroxide based compounds, persulphates, sodium hypochlorite, sodium dichloroisocyanurate.

The composition may further comprise bleach activators and or bleach catalysts. As bleach activators and bleach catalysts any type of bleach activators and bleach catalysts known in the art can be considered.

Dyes are used to colour the detergent parts of the detergent or speckles in the detergent to render the detergent composition more attractive to the consumer. All dyes known in the art can be considered.

Polymers may function as a (co-)builder or dispersing agent. Polymers that are often used in detergent compositions include homo-, co-, or terpolymers of or based on oleic monomer, acrylic acid, methacrylic acid or maleic acid or salts thereof. Such polymers can be combined with or can include monomers.

Corrosion inhibitors can be added for example to reduce or inhibit glass corrosion or metal corrosion. Corrosion inhibitors comprise for example triazole-based compound, polymers with an affinity to attach to glass surfaces, strong oxidizers (like permanganate), cysteine (as silver-protector), silicates, organic and inorganic metal salts, or metal salts of biopolymers.

Complexing agents can be added to capture trace metal ions. Complexing agents can also be used as co-builder or builder. All complexing agents known in the art can be considered.

Anti-redeposition agents prevent the soil form redepositioning on the substrate. Anti-redeposition agents comprise for example carboxymethyl cellulose, polyester-PEG copolymer and polyvinyl pyrrolidone base polymers.

Perfume can be added to the detergent composition to improve the sensorial properties of the composition or of the machine load after cleaning. Also perfumes that have a deodorizing effect can be applied. The perfume can for example be added to the detergent composition as a liquid, paste or as a co-granulate.

Process aids can be added for example to optimize compressibility, friability, toughness, elasticity, disintegration speed, hygroscopicity, density, free flowing properties, stickiness, viscosity, rheology of a detergent composition in a certain physical shape. As process aids all process aids known in the art can be considered.

Enzymes that can be used in detergent compositions include, but are not limited to, proteases, amylases, lipases, cellulases, mannananase, peroxidase, oxidase, xylanase, pullulanase, glucanase, pectinase, cutinase, hemicellulases, glucoamylases, phospholipases, esterases, keratanases, reductases, phenoloxidase, lipoxygenases, ligninases, tannases, pentosanases, malanases, arabinosidases, hyalurodindase, chondroitinase, laccase or mixtures therof. The enzymes can for example be used as a granulate and/or liquid in common amounts.

The detergent composition according to the present invention can be formulated in various forms, for example in the form of a tablet, into the form powder, into the form of a paste or into the form of a liquid composition, into the form of a combination of two or more of these forms. Preferably, the detergent composition is in the form of a tablet.

According to a second aspect of the present invention a method of reducing, limiting or preventing the occurrence of spotting and/or filming on hard surface substrates during rinsing and/or washing is provided. In particular the method reduces, limits or prevents both the occurrence of spots and the occurrence of filming on hard surface substrates during rinsing and/or washing. The method comprises contacting a hard surface substrate with a detergent composition as described above.

A preferred method of reducing, limiting or preventing the occurrence of spotting and/or filming on hard surface substrates comprises the steps of providing the detergent composition as described above to an automatic dishwashing machine; and operating the automatic dishwashing machine.

The method is in particular suitable to reduce, limit or prevent the occurrence of spotting and the occurrence of filming on hard surface substrates.

The automatic dishwashing machine is for example a domestic dishwasher. The maximum cleaning temperature (in the cleaning phase of the dishwashing process) is for example maximum 65° C., maximum 55° C., maximum 50° C. or maximum 45° C.

The dishwashing process comprises preferably a cleaning phase, a rinse phase and a drying phase. Optionally, the dishwashing process comprises a pre-rinse phase before the cleaning phase and/or a second rinse phase between the rinse phase and the drying phase.

According to a third aspect of the present invention, the use of a detergent composition to reduce, limit or prevent the occurrence of spotting and/or filming during the rinsing and/or washing of hard surface substrates is provided. The detergent composition according to the present invention is in particular used to reduce, limit or prevent both the occurrence of spotting and the occurrence of filming during the washing and/or rinsing of hard surface substrates.

The invention will now be described in further details by a number of non-limiting examples of detergent compositions. The detergent compositions are tested in an automatic dishwasher and the cleaned articles are evaluated with respect to spotting and filming.

In a first series of tests three different automatic dishwashing detergent compositions (referred to as ADD1 to ADD3) are tested. The three automatic dishwashing detergent compositions all have the same basic composition as specified in Table 1.

TABLE 1

Basic composition of automatic dishwashing detergent compositions ADD1 to ADD3

| Component | Concentration (wt %) |
|---|---|
| Trinatriumcitrat dihydrat | 30 |
| Sodium carbonate | 28 |
| Sodium percarbonate, coated | 16 |
| Trisodium salt of methylglycinediacetic acid | 6 |
| Modified fatty alcohol polyglycol ether | 4 |
| Polyacrylic acid, partly neutralized | 4 |
| Polycarboxylate | 3 |
| Cellulose based desintegrant | 2 |

TABLE 1-continued

| Basic composition of automatic dishwashing detergent compositions ADD1 to ADD3 | |
|---|---|
| Component | Concentration (wt %) |
| Further components: protease granulate, amylase granulate, tabletting aid, glass corrosion inhibitor, metal protecting agent, cellulose derivates, bleach catalyst, phosphonate, dye, perfume | added up to 100 wt % |
| Total (wt %) | 100 |
| Total weight (g) | 19 |

The compositions ADD2 and ADD3 each comprise an additive added to the composition as specified in Table 1, i.e. added on top of the 19 grams dose as specified in Table 1. The additives and their concentrations are given in Table 2. For the composition ADD2, the additive comprises a biobased polysaccharide, more particularly cationic inulin indicated as Catin® 350 meeting the requirements of the present invention with respect to molecular weight, degree of substitution and solubility. For the composition ADD3, the additive comprises a non-biobased cationic polymer referred to as Mirapol Surf-S P-free Power. Mirapol Surf-S P-free Power comprises a blend of a copolymer of acrylic acid and diallyldimethylammonium chloride (DADMAC) (18%) and sodium carbonate. ADD1 is a reference sample having no additives added to the composition as specified in Table 1.

TABLE 2

| Additive for the compositions ADD1, ADD2 and ADD3 | | |
|---|---|---|
| Composition Number | Additive | Concentration (wt %) |
| ADD1 | / | / |
| ADD2 | Catin ® 350 | 0.12 |
| ADD3 | Mirapol Surf S-P free Power | 0.70 |

In a second series of tests four different automatic dishwashing detergent compositions (referred to as ADD7, ADD9, ADD10 and ADD11) are tested. The four compositions all have the same basic composition as specified in Table 3.

TABLE 3

| Basic composition of automatic dishwashing detergent compositions ADD7 to ADD14 | |
|---|---|
| Component | Concentration (wt %) |
| Trinatriumcitrat dihydrat | 36 |
| Sodium carbonate | 24 |
| Sodium percarbonate, coated | 13 |
| Modified fatty alcohol polyglycol ether | 5 |
| Trisodium salt of methylglycinediacetic acid | 4 |
| Tetra-acetylethyleendiamine | 4 |
| Polycarboxylate | 4 |
| Acrylic acid/Maleic acid copolymer | 2 |

TABLE 3-continued

| Basic composition of automatic dishwashing detergent compositions ADD7 to ADD14 | |
|---|---|
| Component | Concentration (wt %) |
| Further components: protease granulate, amylase granulate, tabletting aid, proces aids, glass corrosion inhibitor, metal protecting agent, amphoteric sufactant, cellulose derivates, bleach catalyst, phosphonate, dye, perfume | added up to 100 wt % |
| Total (wt %) | 100 |
| Total weight (g) | 17.5 |

In the compositions ADD9, ADD10 and ADD11 a cationic derivate of a polysaccharide is added to the composition on top of the composition as specified in Table 3, i.e. on top of the 17.5 grams dose. The additives and their concentrations are given in Table 4. The additives added to the compositions ADD9, ADD10 and ADD11 all comprise cationic inulin meeting the requirements with respect to molecular weight, degree of substitution and solubility as specified by the present invention. The compositions ADD9, ADD10 and ADD11 comprise cationic inulin having a degree of substitution of respectively 0.35, 0.68 and 1.28, all in a concentration of 0.13 wt %. The additives are respectively referred to as Catin® 350, Catin® 680 and Catin® 1280. ADD7 is a reference composition having no addition of a cationic derivate of polysaccharide.

TABLE 4

| Additive for the compositions ADD7, ADD9, ADD10 and ADD11 | | |
|---|---|---|
| Composition Number | Additive | Concentration (wt %) |
| ADD7 | / | / |
| ADD9 | Catin ® 350 | 0.13 |
| ADD10 | Catin ® 680 | 0.13 |
| ADD11 | Catin ® 1280 | 0.13 |

In a third series of tests four additional automatic dishwashing detergent compositions (referred to as ADD12, ADD13, ADD9 and ADD14) are tested. The four compositions all have the same basic composition as specified in Table 3.

In the compositions ADD12, ADD13, ADD9 and ADD14 a cationic derivate of a polysaccharide is added to the composition on top of the composition as specified in Table 3, i.e. on top of the 17.5 grams dose. The additives and their concentrations are given in Table 5. The compositions ADD12, ADD13, ADD9 and ADD14 all comprise cationic inulin meeting the requirements with respect to molecular weight, degree of substitution and solubility as specified by the present invention. The compositions ADD12, ADD13, ADD9 and ADD14 all comprise cationic inulin having a degree of substitution of 0.35 (referred to as Catin® 350), respectively in a concentration of 0.04 wt %, 0.08 wt %, 0.13 wt % and 0.38 wt %.

TABLE 5

Additive for the compositions ADD12, ADD13, ADD9 and ADD14

| Composition Number | Additive | Concentration (wt %) |
|---|---|---|
| ADD12 | Catin ® 350 | 0.04 |
| ADD13 | Catin ® 350 | 0.08 |
| ADD9 | Catin ® 350 | 0.13 |
| ADD14 | Catin ® 350 | 0.38 |

To determine the rinse performance of the automatic dishwashing detergent compositions the compositions were tested in an automatic dishwashing machine, with a ballast soil mix.

The results are evaluated with reference to the number and intensity of spots and to the intensity and nature of the filming.

The dishwashing machine used in the test is a Miele GSL. The program used is 50° with R-Zeit 2 (8 minutes).

An amount of 90 g of frozen ballast soil in a glass jar was placed upside-down in the dishwasher at the moment it was turned on. The ballast soil had a temperature −25 to −15° C. at the moment it was placed in the dishwasher. The ballast soil had the following composition:

150 weight parts of margarine
200 weight parts of egg yolk
400 weight parts of egg white
150 weight parts of potato starch
60 weight parts of cooking salt (sodium chloride)
3540 weight parts of water The detergent composition is dosed manually by opening the door of the dishwasher at the moment it would dose the detergent automatically. The detergent is dosed as a powder.

The used dishwasher is loaded with the following items of which some are ballast load and some are evaluated for determining the performance:

3× Tupperware Salad bowl, 600 ml,
2× IKEA Plastic plates, KALAS, 900.969.08/13643,
3× Rosti Mepal basic lunchplate p220-ocean,
2× WACA, SAN plate, blue, Ø 24 cm,
1× Schott Zwiesel, Cognac-glass,
2× Schott Zwiesel, Paris beerglas, 275 ml, form 4858-42,
2× Cola glass, stackable, 22 cl,
2× Arcoroc, whisky glass Islande, 20 cl,
1× Schott Zwiesel, Mondial waterglass, 323 ml, form 7500,
7× Bauscher, black plate, Teller flach Fahne 1030/20,
4× WMF, knife (Vorspeise-/Dessertmes), type Berlin, 11 3806 6099,
1× WMF, dessert knife Solid, SKU: 12.7906.6049,
4× Stainless steel plate, 200×40×1 mm, During the rinse-aid performance test the dishwasher runs 6 times of which the last three times one wash is performed per day after which a selection of the load of the dishwasher is judged manually on spots and filming. The judged items are the glasses (Schott Zwiesel, Mondial waterglass, 323 ml, form 7500 Mondial; Schott Zwiesel, Paris beerglas, 275 ml, form 4858-42; Arcoroc, whisky glass Islande, 20 cl; Cola glass, stackable, 22 cl), two salad bowls (Tupperware Salad bowls, 600 ml), a lunchplate (Rosti Mepal basic lunchplate p220-ocean), a black plate (Bauscher, black plate, Teller flach Fahne 1030/20) and knives (WMF, knife (Vorspeise-/Dessertmes), type Berlin, 11 3806 6099 Berlin and dessert knife Solid, SKU: 12.7906.6049). These items are grouped in the categories: glass, plastic, ceramic and steel.

The number of spots, the intensity of the spots and the intensity of the filming on the items in the dishwasher are manually judged according to the scale below.

10=no spots/no filming
9=very low intensity or number of spots/intensity of filming
8=intermediate score
7=low intensity or number of spots/intensity of filming
6=intermediate score
5=medium intensity or number of spots/intensity of filming
4=intermediate score
3=high intensity or number of spots/intensity of filming
2=intermediate score
1=very high intensity or number of spots/intensity of filming The score on spots is the average of the score that was obtained in view of the intensity of the spots and the number of spots found on the judged items.

The used water for the first series of tests is tap-water from Heerde, the Netherlands, that has been hardened up to 21 degrees German hardness, by adding aqueous solutions of calcium chloride, magnesium sulphate and sodium bicarbonate. The used water contains calcium and magnesium ions in a ratio of roughly 3.5:1 and between 4 and 5.5 mmol HCO3—per liter.

The used water for the second and third series of tests is tap-water from Heerde, the Netherlands, that has been hardened up to 21 degrees German hardness, by adding aqueous solutions of calcium chloride, magnesium sulphate and sodium bicarbonate. The used water contains calcium and magnesium ions in a ratio of roughly 3:1 and between 3.5 and 5 mmol HCO3—per liter.

In the first series of tests the performance on spotting and filming of a reference composition (ADD1) is compared with the performance on spotting and filming of a composition comprising a cationic derivate of a polysaccharide meeting the requirements of the present invention (Catin® 350) (ADD2) and with the performance on spotting and filming of a composition comprising a cationic polymer not meeting the requirements of the present invention (ADD3). The performance on spotting of the compositions ADD1, ADD2 and ADD3 is shown in Table 6. The performance on filming of the compositions ADD1, ADD2, ADD3 is shown in Table 7. The total performance (spotting * filming) of the compositions ADD1, ADD2 and ADD3 is shown in Table 8.

TABLE 6

Performance on spotting of ADD1, ADD2 and ADD3

| | Glasses | Plastics | Ceramics | Knives | Total (average) |
|---|---|---|---|---|---|
| ADD1 | 5.2 | 4.0 | 6.0 | 7.0 | 5.5 |
| ADD2 | 6.9 | 5.2 | 7.0 | 7.0 | 6.5 |
| ADD3 | 5.7 | 5.0 | 6.3 | 7.0 | 6.0 |

TABLE 7

Performance on filming of ADD1, ADD2 and ADD3

| | Glasses | Plastics | Ceramics | Knives | Total (average) |
|---|---|---|---|---|---|
| ADD1 | 3.9 | 4.8 | 4.0 | 6.7 | 4.9 |
| ADD2 | 4.9 | 5.5 | 4.3 | 4.3 | 4.8 |
| ADD3 | 3.5 | 5.0 | 3.7 | 5.3 | 4.4 |

TABLE 8

| Total performance (spotting * filming) of ADD1, ADD2 and ADD3 | | | |
|---|---|---|---|
| | Total spotting | Total filming | Total spotting * filming |
| ADD1 | 5.5 | 4.9 | 26.95 |
| ADD2 | 6.5 | 4.8 | 31.20 |
| ADD3 | 6.0 | 4.4 | 26.40 |

From Table 6 one can derive that the compositions ADD2 and ADD3 both show a good performance on spotting. The composition of ADD2 (comprising an additive meeting the requirements of the present invention) shows a slightly better performance than the composition of ADD3 (comprising an additive not meeting the requirements of the present invention). From Table 7 one can derive that the performance on filming of composition ADD2 (comprising an additive meeting the requirements of the present invention) remains quasi unchanged compared to the performance of the reference composition ADD1. The performance on filming of ADD3 (comprising an additive not meeting the requirements of the present invention) is reduced compared to the performance of the reference composition ADD1.

The total performance of composition ADD2 (comprising an additive meeting the requirements of the present invention) is higher than the total performance of the reference composition ADD1; the total performance of the composition ADD3 (comprising an additive not meeting the requirements of the present invention) is lower than the total performance of the reference composition ADD1.

In the second series of tests the performance on spotting and filming of a reference composition comprising no cationic derivate of a polysaccharide (ADD7) is compared with the performance on spotting and filming of a composition comprising cationic inulin in the same concentration having different degrees of substitution (ADD9 having a degree of substitution of 0.35, ADD10 having a degree of substitution of 0.68 and ADD11 having a degree of substitution of 1.28).

The performance on spotting of the compositions is shown in Table 9, the performance on filming is shown in Table 10 and the total performance (spotting * filming) is shown in Table 11.

TABLE 9

| Performance on spotting of ADD7, ADD9, ADD10 and ADD11 | | | | | |
|---|---|---|---|---|---|
| | Glasses | Plastics | Ceramics | Knives | Total (average) |
| ADD7 | 2 | 4 | 2.7 | 7.0 | 3.9 |
| ADD9 | 7 | 3.7 | 7.0 | 7.0 | 6.2 |
| ADD10 | 7 | 4.0 | 7.0 | 7.0 | 6.3 |
| ADD11 | 7 | 5.1 | 7.0 | 7.0 | 6.5 |

TABLE 10

| Performance on filming of ADD7, ADD9, ADD10 and ADD11 | | | | | |
|---|---|---|---|---|---|
| | Glasses | Plastics | Ceramics | Knives | Total (average) |
| ADD7 | 4.9 | 4.2 | 4.0 | 4.7 | 4.4 |
| ADD9 | 3.9 | 4.5 | 3.3 | 3.7 | 3.9 |
| ADD10 | 3.6 | 4.0 | 2.7 | 3.0 | 3.3 |
| ADD11 | 3.3 | 4.2 | 2.3 | 2.7 | 3.1 |

TABLE 11

| Total performance (spotting * filming) of ADD7, ADD9, ADD10 and ADD11 | | | |
|---|---|---|---|
| | Total spotting | Total filming | Total spotting * filming |
| ADD7 | 3.9 | 4.4 | 17.16 |
| ADD9 | 6.2 | 3.9 | 24.18 |
| ADD10 | 6.3 | 3.3 | 20.79 |
| ADD11 | 6.5 | 3.1 | 20.15 |

From Table 9 it can be derived that the compositions ADD9, ADD10 and ADD11 all have an improved performance on spotting compared to the reference composition ADD7.

From Table 10 it can be derived that the performance on filming decreases with increasing degree of substitution. The best performance on filming is obtained for cationic inulin having a degree of substitution smaller than 0.68.

From Table 11 it can be derived that the total performance of the compositions ADD9 to ADD11 is increased compared to the reference composition ADD7, even for the compositions having a high degree of substitution (for example ADD10 having a degree of substitution of 0.68 and ADD11 having a degree of substitution of 1.28).

The third series of tests comprise the comparison of the performance on spotting and filming of compositions comprising a cationic derivate of a polysaccharide, more particular cationic inulin having a degree of substitution of 0.35 (referred to as Catin® 350) in different concentrations. The composition ADD12 comprises Catin® 350 in a concentration of 0.04 wt %, the composition ADD13 comprises Catin® 350 in a concentration of 0.08 wt %, the composition ADD9 comprises Catin® 350 in a concentration of 0.13 wt %, and the composition ADD14 comprises Catin® 350 in a concentration of 0.38 wt %.

The performance on spotting of the compositions is shown in Table 12, the performance on filming is shown in Table 13 and the total performance is shown in Table 14.

TABLE 12

| Performance on spotting of ADD12, ADD13, ADD9 and ADD14 | | | | | |
|---|---|---|---|---|---|
| | Glasses | Plastics | Ceramics | Knives | Total (average) |
| ADD12 | 6.8 | 4.2 | 7.0 | 7.0 | 6.2 |
| ADD13 | 7.0 | 4.8 | 7.0 | 7.0 | 6.5 |
| ADD9 | 7.0 | 4.2 | 7.0 | 7.0 | 6.3 |
| ADD14 | 7.0 | 4.5 | 7.0 | 7.0 | 6.4 |

TABLE 13

| Performance on filming of ADD12, ADD13, ADD9 and ADD14 | | | | | |
|---|---|---|---|---|---|
| | Glasses | Plastics | Ceramics | Knives | Total (average) |
| ADD12 | 4.3 | 4.5 | 4.3 | 4.0 | 4.3 |
| ADD13 | 4.7 | 4.5 | 4.3 | 4.0 | 4.4 |
| ADD9 | 4.3 | 4.5 | 4.0 | 4.0 | 4.2 |
| ADD14 | 4.8 | 5.0 | 4.3 | 4.0 | 4.5 |

TABLE 14

Total performance (spotting * filming) of ADD12, ADD13, ADD9 and ADD14

| | Total spotting | Total filming | Total spotting * filming |
|---|---|---|---|
| ADD12 | 6.2 | 4.3 | 26.66 |
| ADD13 | 6.5 | 4.4 | 28.60 |
| ADD9 | 6.3 | 4.2 | 26.46 |
| ADD14 | 6.4 | 4.5 | 28.80 |

From Table 12, Table 13 and Table 14 it can be derived that the performance on spotting and the performance on filming for the compositions ADD12, ADD13, ADD9 and ADD14 is similar. The concentration of the cationic derivate of the polysaccharide (Catin® 350) has no (or very little) influence on the performance on spotting nor on the performance of filming.

Although applicant does not want to be bound by any theory, it is believed that by using a cationic derivative of a polysaccharide having an average molecular weight, a degree of substitution and a solubility in water as specified, an optimum is obtained whereby a polymeric layer is formed on the hard surface substrates showing an appropriate adhesion on the hard surface substrates.

The invention claimed is:

1. A method of reducing, limiting or preventing the occurrence of spotting and/or filming on hard surface substrates during rinsing and/or washing of the hard surface substrates, the method comprising contacting the hard surface substrates with an automatic dishwashing detergent composition comprising amylase and at least one cationic derivate of a polysaccharide comprising a cationic derivate of inulin and having an average molecular weight of less than 30000 g/mol and a degree of substitution ranging between 0.1 and 3.

2. The method according to claim 1, further comprising:

(a) providing the automatic dishwashing detergent composition to an automatic dishwashing machine; and (b) operating the automatic dishwashing machine.

3. An automatic dishwashing detergent composition comprising amylase and at least one cationic derivate of a polysaccharide comprising a cationic derivate of inulin and having an average molecular weight of less than 30000 g/mol and a degree of substitution ranging between 0.1 and 3.

4. The automatic dishwashing detergent composition according to claim 3, wherein the at least one cationic derivate of a polysaccharide has a solubility in water at a temperature of 25° C. of at least 20% (wt).

5. The automatic dishwashing detergent composition according to claim 3, wherein the cationic derivate of a polysaccharide has an average molecular weight ranging between 1000 g/mol and 15000 g/mol.

6. The automatic dishwashing detergent composition according to claim 3, wherein the cationic derivate of a polysaccharide has a degree of substitution ranging between 0.20 and 2.

7. The automatic dishwashing detergent composition according to claim 3, wherein the cationic derivate of a polysaccharide has a solubility in water at a temperature of 25° C. of at least 40% (wt).

8. The automatic dishwashing detergent composition according to claim 3, wherein the cationic inulin has an average molecular weight of less than 30000 g/mol and a degree of substitution ranging between 0.15 and 3.

9. The automatic dishwashing detergent composition according to claim 3, wherein the cationic inulin has an average molecular weight ranging between 1000 g/mol and 15000 g/mol, a degree of substitution ranging between 0.15 and 2 and a solubility in water at a temperature of 25° C. of at least 20% (wt).

10. The automatic dishwashing detergent composition according to claim 3, wherein the cationic derivate of a polysaccharide is present in the detergent composition in a concentration ranging between 0.01 wt % and 2 wt %.

11. The automatic dishwashing detergent composition according to claim 3, wherein the automatic dishwashing detergent composition further comprises one or more surfactants, builders, bleaching agents, bleach activators, bleach catalysts, dyes, polymers, corrosion inhibitors, complexing agents, anti-redeposition agents, perfumes, process aids and/or enzymes.

* * * * *